US008262193B2

(12) United States Patent
Okazaki et al.

(10) Patent No.: US 8,262,193 B2
(45) Date of Patent: Sep. 11, 2012

(54) LIQUID DROPLET JETTING APPARATUS

(75) Inventors: Naoya Okazaki, Gifu-ken (JP); Yoichiro Shimizu, Kasugai (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 370 days.

(21) Appl. No.: 12/508,256

(22) Filed: Jul. 23, 2009

(65) Prior Publication Data

US 2010/0020124 A1 Jan. 28, 2010

(30) Foreign Application Priority Data

Jul. 25, 2008 (JP) ..... 2008-191929

(51) Int. Cl.
*B41J 2/165* (2006.01)

(52) U.S. Cl. ..... 347/29

(58) Field of Classification Search ..... None
See application file for complete search history.

(56) References Cited

U.S. PATENT DOCUMENTS

| | | | | |
|---|---|---|---|---|
| 5,398,049 | A * | 3/1995 | Terasawa et al. | 347/8 |
| 6,467,873 | B1 * | 10/2002 | Toba et al. | 347/33 |
| 6,543,876 | B2 * | 4/2003 | Kotaki | 347/30 |
| 6,616,264 | B2 * | 9/2003 | Mitsuzawa et al. | 347/23 |
| 6,629,787 | B2 * | 10/2003 | Lee et al. | 400/59 |
| 2007/0085874 | A1 | 4/2007 | Shindo | |
| 2007/0122220 | A1 | 5/2007 | Tamaki et al. | |

FOREIGN PATENT DOCUMENTS

| | | |
|---|---|---|
| JP | 7-179000 | 7/1995 |
| JP | 2004-306524 | 11/2004 |
| JP | 2007-111911 | 5/2007 |
| JP | 2007-144766 | 6/2007 |
| JP | 2007196629 | 8/2007 |
| JP | 2007-223048 | 9/2007 |

* cited by examiner

*Primary Examiner* — Matthew Luu
*Assistant Examiner* — Alejandro Valencia
(74) *Attorney, Agent, or Firm* — Frommer Lawrence & Haug LLP

(57) ABSTRACT

A liquid droplet jetting apparatus includes a jetting head unit which jets liquid droplet from nozzles, and which is displaced in a jetting direction in which the liquid droplets are jetted and in an opposite direction opposite to the jetting direction, a capping mechanism including a cap covering a nozzle opening surface in which the nozzles of the jetting head unit open, and performing a capping operation in which the cap is moved in the opposite direction from a stand-by position, which is away from the nozzle opening surface, to a capping position at which the cap covers the nozzle opening surface, a stopper which is arranged with a spacing distance from the jetting head unit, and which regulates a displacement of the jetting head unit in the opposite direction, and a first buffer which is arranged between the jetting head unit and the stopper.

6 Claims, 14 Drawing Sheets

LIQUID DROPLET JETTING APPARATUS

CROSS REFERENCE TO RELATED APPLICATION

The present application claims priority from Japanese Patent Application No. 2008-191929, filed on Jul. 25, 2008, the disclosure of which is incorporated herein by reference in its entirety.

BACKGROUND OF THE INVENTION

1. Field of the Invention

The present invention relates to a liquid droplet jetting apparatus which jets liquid droplets onto a recording medium.

2. Description of the Related Art

In an ink-jet recording apparatus which is a liquid droplet jetting apparatus, it has hitherto been known that when a viscosity of an ink near nozzles increases due to drying, or when impurities such as dust are adhered on an opening surface of the nozzles, a bending of jetting (a deflection in direction of jetting) and blocking of nozzles occur, thereby imparting an adverse effect on a jetting performance. Therefore, in conventional ink-jet recording apparatus, when a jetting head is waiting for a jetting command, or when an electric power supply of an apparatus has been put OFF, a nozzle opening surface of the jetting head is covered by a cap.

In such an ink-jet recording apparatus, since a vacuum pump is connected to the cap, with the nozzle opening surface in a state of being covered by the cap, it is possible to carry out suction for forcibly discharging defective ink (such as dry ink) from the nozzle. For carrying out the suction, since it is necessary that the cap is in a close contact with the nozzle opening surface, a bias applying mechanism which applies a bias to the cap toward the nozzle opening surface is provided.

Generally, a carriage on which the jetting head is mounted is not fixed to a guide member such that the carriage is moved slidably on the guide member, and when the nozzle opening surface is covered by the cap, a force which moves the jetting head together with the carriage in a direction of the bias applied is exerted by a bias applying member which applies the bias on the cap toward the nozzle opening surface. When no force resisting the force moving the jetting head acts on the carriage, it is not possible to bring the cap in a close contact with the nozzle opening surface, resulting in an insufficient suction force at the time of suction, or a variation in the suction force. Therefore, a regulating portion is provided in advance at a position at which the carriage makes a contact when moved, and the carriage is regulated to stay without being moved by the movement of the cap, in a state of being covered by the cap, and an arrangement is made such that the cap is deformed assuredly, and is in a close contact with the nozzle opening surface.

When the nozzle opening surface is covered by the cap as described above, the carriage is displaced together with the cap, and an impact when the carriage hits the regulating portion is transmitted to the jetting head.

Therefore, when the jetting head is displaced together with the carriage, sometimes a meniscus is destroyed by the impact when abutted with the regulating portion. In this case, when an attempt is made to jet an ink onto a paper by the subsequent operation, since the meniscus is not formed properly, a jetting defect occurs.

SUMMARY OF THE INVENTION

The present invention is made to solve the abovementioned problem, and an object of the present invention is to prevent the meniscus from being destroyed (from being broken) by an impact when an impact is imparted to the jetting head by the jetting head being displaced together with the carriage, and abutting with the regulating portion.

According to a first aspect of the present invention, there is provided a liquid droplet jetting apparatus which jets liquid droplets toward a recording medium, including a jetting head unit having a nozzle opening surface on which nozzles for jetting the liquid droplets are open, and the jetting head unit being configured to be displaced in a jetting direction in which the liquid droplets are jetted from the nozzles toward the recording medium and in an opposite direction opposite to the jetting direction; a capping mechanism including a cap covering the nozzle opening surface, and which moves the cap in the opposite direction from a stand-by position, which is away from the nozzle opening surface, to a capping position at which the cap is brought into contact with and covers the nozzle opening surface; a stopper which is arranged with a spacing distance from the jetting head unit, and which regulates a displacement of the jetting head unit in the opposite direction; and a first buffer which is arranged between the jetting head unit and the stopper, and when the capping mechanism moves the cap in the opposite direction to make the jetting head unit contact with the stopper, the first buffer contracts by being pressed by the jetting head unit.

According to the first aspect of the present invention, when the jetting head unit is displaced in the direction opposite to the jetting direction by the capping operation of the capping mechanism, the jetting head unit reaches the position of abutting with the stopper while being contracted while pressing the first buffer. Accordingly, since it is possible to make the jetting head unit abut with the first buffer ahead of the stopper, it is possible to suppress an impact on the jetting head unit, as compared to a case of colliding directly with the stopper. Moreover, when displaced, since the first buffer contracts by being pressed, a restoring force is generated in the first buffer due to the contraction. Since it is possible to make the restoring force act in the jetting direction, it is possible to ease up (buffer against) the impact by the collision with the stopper as compared to a case of making collide with the stopper directly without sandwiching the first buffer. Therefore, it is possible to suppress the impact on the jetting head at the time of capping, and to prevent a meniscus formed in the nozzle from being broken.

DETAILED DESCRIPTION OF THE PREFERRED EMBODIMENTS

Figure 1:
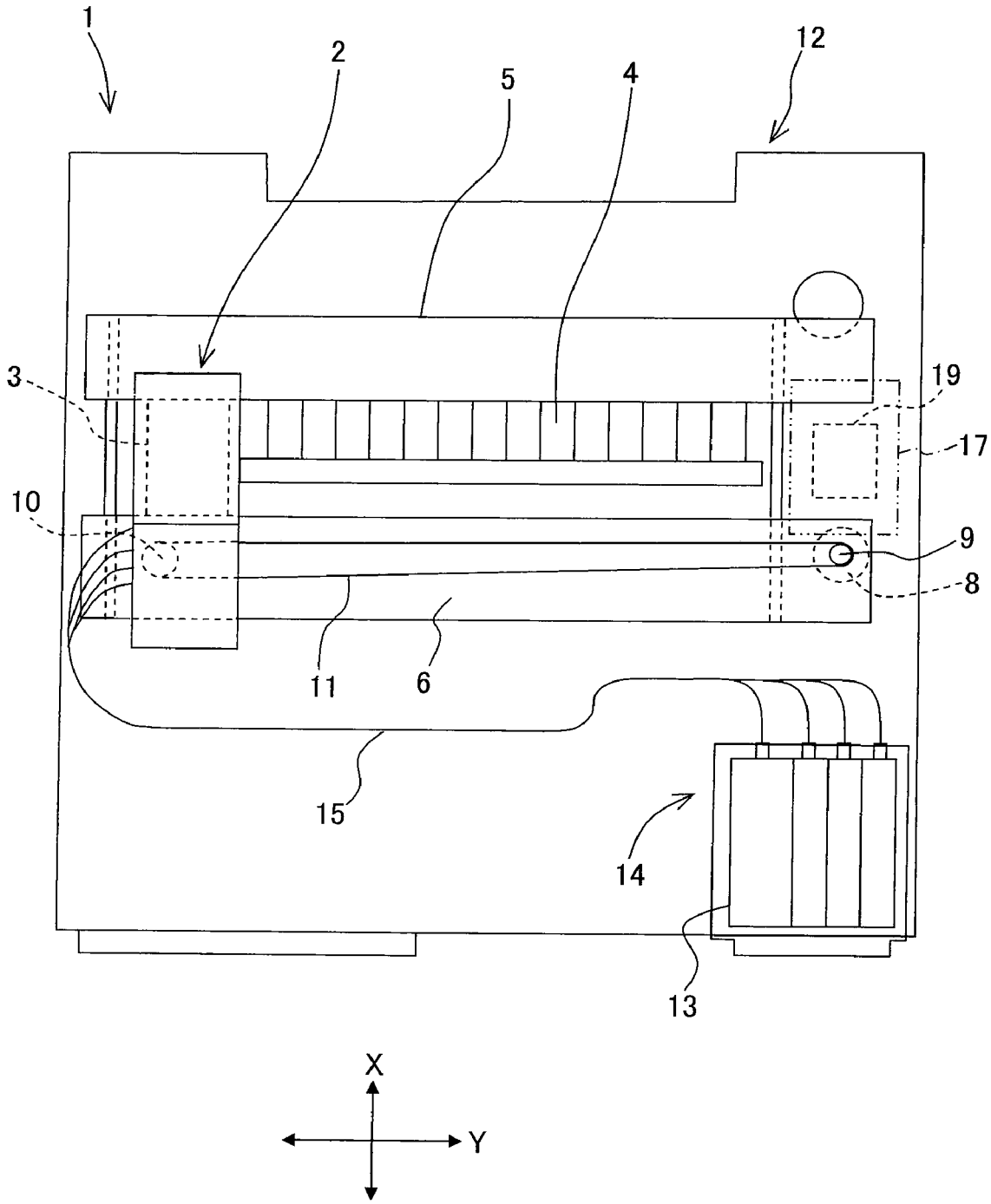
FIG. 1 is a schematic plan view of an image recording apparatus 1 which is a liquid droplet jetting apparatus.

Exemplary embodiments for implementing the present invention will be described below by referring to the accompanying diagrams. As shown in FIG. 1, the image recording apparatus 1 may be applied to a single printer, or to a printer function of a multi function device (MFD) provided with a plurality of functions such as a facsimile function and a copy function.

Figure 3:
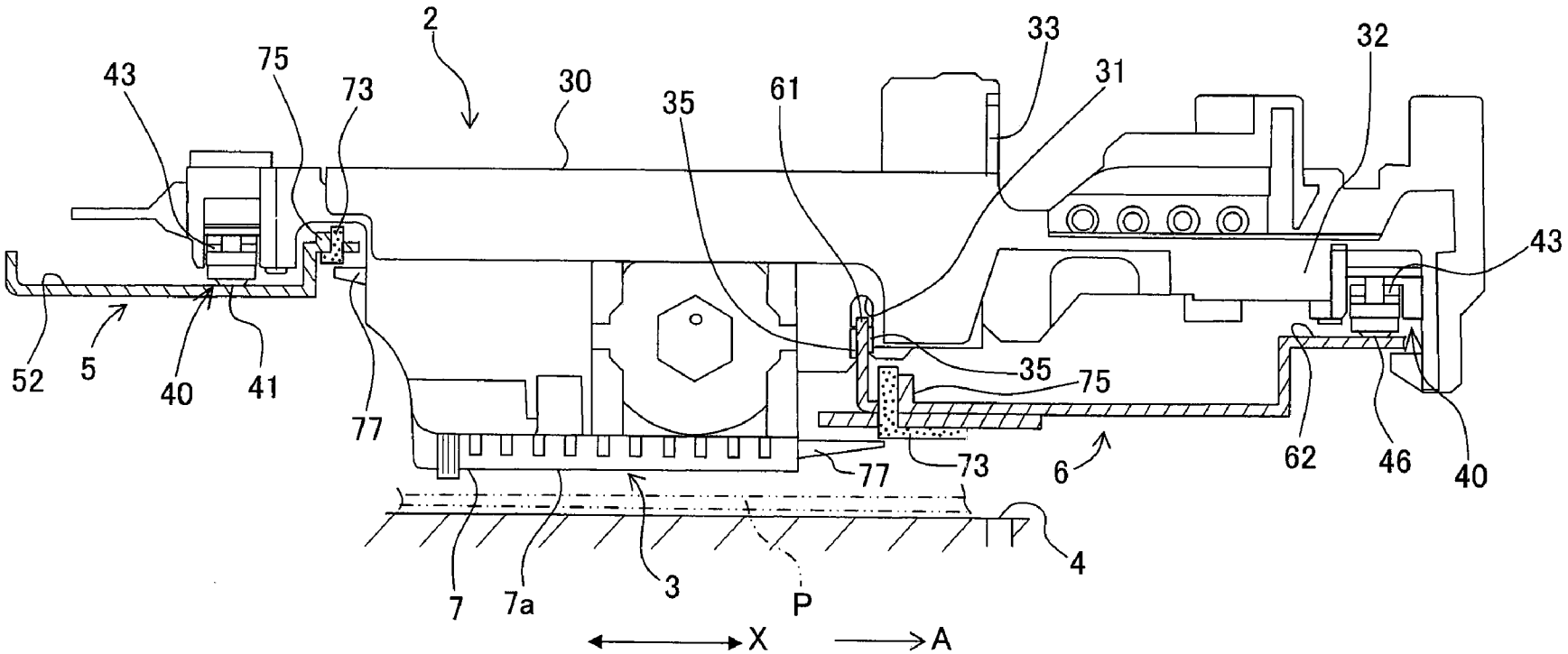
FIG. 3 is a cross-sectional view taken along a line III-III in FIG. 2.

The image recording apparatus 1, as shown in FIG. 1 and FIG. 3, has a jetting head unit 3 mounted on a carriage 2, and a platen 4 provided facing a lower surface of the jetting head unit 3. The jetting head unit 3 has nozzles 7 exposed to a paper P as a recording medium on the platen 4 (refer to FIG. 3 and FIG. 4). In the following description, a side on which the nozzles 7 of the jetting head unit 3 open is let to be a lower side, and a side opposite to the lower side is let to be an upper side.

The carriage 2 is supported to be spreading over a first guide member 5 and a second guide member 6, such that the carriage 2 is parallel (Y-axis direction) to the paper P on the platen 4. A carriage motor 8, a drive pulley 9 coupled with the carriage motor 8, a driven pulley 10, and a timing belt 11 which is put around the drive pulley 9 and the driven pulley 10 are provided as a moving mechanism of the carriage 2. By the moving mechanism, the carriage 2 reciprocates in a main scanning direction along the first guide member 5 and the second guide member 6.

Figure 2:
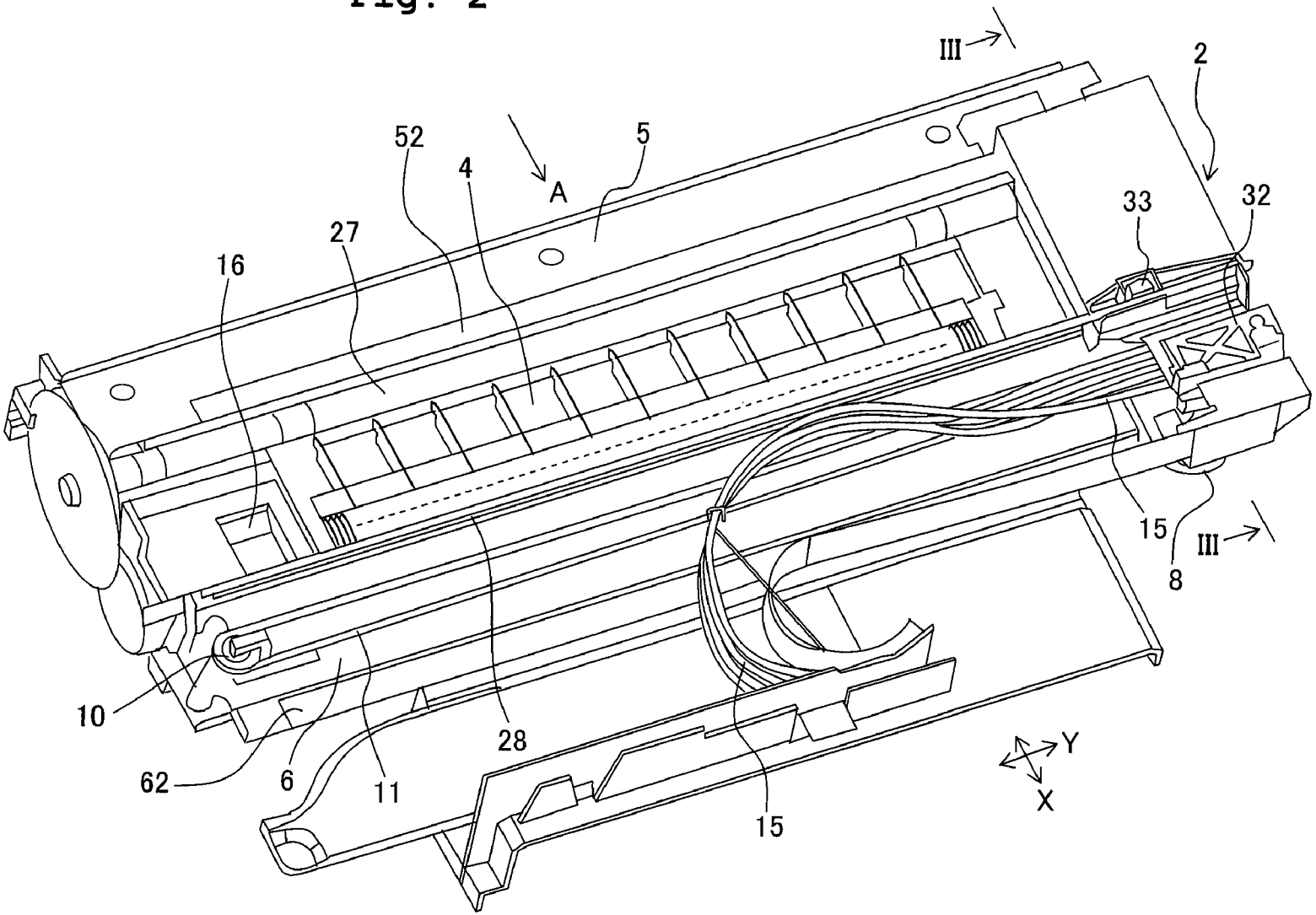
FIG. 2 is a perspective view of an image recording section.

The paper P is transported on the platen 4 by a transporting roller 27 and a pinch roller (not shown in the diagram) along a secondary scanning direction (X-axis direction) orthogonal to the main scanning direction (Y-axis direction) (refer to FIG. 2). In other words, the jetting head unit 3 jets an ink onto the paper P from the nozzles 7 while moving in the main scanning direction (Y-axis direction), as it has hitherto been known, and the paper P is transported by a predetermined distance in the secondary scanning direction (X-axis direction) after each main scanning.

As shown in FIG. 2, a linear encoder scale 28 in the form of a belt is arranged parallel to the main scanning direction of the carriage 2, and a light-transmission type sensor (photo-coupler) 33 for reading a mark provided on the linear encoder scale 28 is installed on the carriage 2 (refer to FIG. 2). By reading the mark of the linear encoder scale 28 which passes, by the light-transmission type sensor (photo-coupler) 33, it is possible to detect a movement speed, and a position of the carriage 2 in the Y-axis direction (main scanning direction).

An accommodating section 14 of an ink cartridge 13 which is replaceable is provided inside the main-body frame 12 as shown in FIG. 1, and the ink cartridges 13 corresponding to the number of ink colors (here, the ink cartridges 13 for black ink, cyan ink, magenta ink, and yellow ink respectively) are accommodated in the accommodating portion 14. Ink from each ink cartridge 13 is supplied independently to the jetting head unit 3 of the carriage 2 via an ink supply tube (a tube made of a resin) 15 having a flexibility.

As shown in FIG. 1 and FIG. 2, a waste ink receiving section 16 is provided inside the main-body frame 12, on one side (left side in FIG. 1 and FIG. 2) at an outer side of a width (recording area) in the Y-axis direction of the paper P, and a maintenance unit 17 (capping mechanism) corresponding to a stand-by position (a home position) of the carriage 2 is provided at the other side thereof (right side in FIG. 1 and FIG. 2). The jetting head unit 3 carries out ink jetting (flushing) for preventing blocking of nozzles periodically before recording or during recording operation, at a position facing the waste ink receiving section 16.

A cap 19 for covering a nozzle opening surface 7*a* when the jetting head unit 3 is waiting for a recording command, or when an electric power supply to the apparatus is OFF, is provided to the maintenance unit 17. A suction pump 22 is connected to the cap 19, and it is possible to carry out a recovery operation (purge operation) of discharging a degraded ink such as a thickened ink from the nozzles 7, in a state of the cap 19 covering the nozzle opening surface 7*a*. Moreover, a wiping member in the form of a blade (not shown in the diagram) is arranged parallel to the cap 19. The wiping member which has ascended to a position where it is capable of making a contact with the nozzle opening surface 7*a* wipes the nozzle opening surface 7*a* relatively by a movement of the jetting head unit 3 in the main scanning direction, and is capable of removing ink and paper dust etc. adhered to the nozzle opening surface 7*a* (wiping operation).

A lift mechanism 21 which brings closer and draws away the cap 19 along the jetting direction (Z-axis direction) of the ink jetted from the nozzles 7 is connected to the cap 19. An arrangement is made such that when the cap 19 has made a contact with the nozzle opening surface 7*a*, a thrust which applies a bias to the cap 19 toward the nozzle opening surface 7*a* acts. This operation will be described later.

The cap 19 is made of an elastic material such as rubber, and has a rib 19*a* at a position where it is possible to cover collectively a surrounding of all the nozzles 7 when the cap 19 has covered the nozzle opening surface 7*a*. Consequently, the cap 19, when pushed (pressed) toward the nozzle opening surface 7*a*, makes a close contact with the nozzle opening surface 7*a*, by the rib 19*a* being subjected to an elastic deformation.

Next, a structure of the carriage 2 and members around the carriage 2 will be described below in detail. Both the first guide member 5 positioned at an upstream side in the paper transporting direction (direction of arrow A) and the second guide member 6 positioned at a downstream side in the paper transporting direction are made of a flat metal plate (in the a plate) having a substantially same length in the Y-axis direction. Both end portions in the Y-axis direction of the first guide member 5 and the second guide member 6 are cut and bent upward, and contact sites 70*a* (70*b*) and 71*a* (71*b*) with which a gap adjusting member 43 which will be described later can make a contact are formed. The contact site 70*a* (71*a*) is a right-side contact site in FIG. 1, FIG. 7, and FIG. 8, and the contact site 70*b* (71*b*) is a left-side contact site.

An edge portion 61 which is bent upward at a substantially right angle is formed at an end portion of the second guide member 6, at the upstream side in the paper transporting direction (refer to FIG. 3). On the other hand, at a lower-surface side of a head holder 30, a downward recess 31 which has opened downward is formed to be longer in the Y-axis direction, near a central portion in the X-direction thereof.

The edge portion 61 is pinched between a sliding portion 35 which is arranged to face an inner side of the downward recess 31.

The first guide member 5 and the second guide member 6 are arranged at different heights, and the carriage 2 is slidably mounted on an upper surface of the first guide member 5 and the second guide member 6. A position in the X-axis direction of the carriage 2 is regulated by engagement of the edge portion 61 of the second guide member 6 and the downward recess 31 of the head holder 30. A gap adjusting mechanism 40 which will be described later is provided between the first guide member 5, the second guide member 6, and the carriage 2. Moreover, as shown in FIG. 3, in the first guide member 5 and the second guide member 6, a first buffer 73 which will be described later is arranged closer to the nozzle opening surface 7*a* of the jetting head unit 3 than the gap adjusting mechanism 40.

Figure 4:
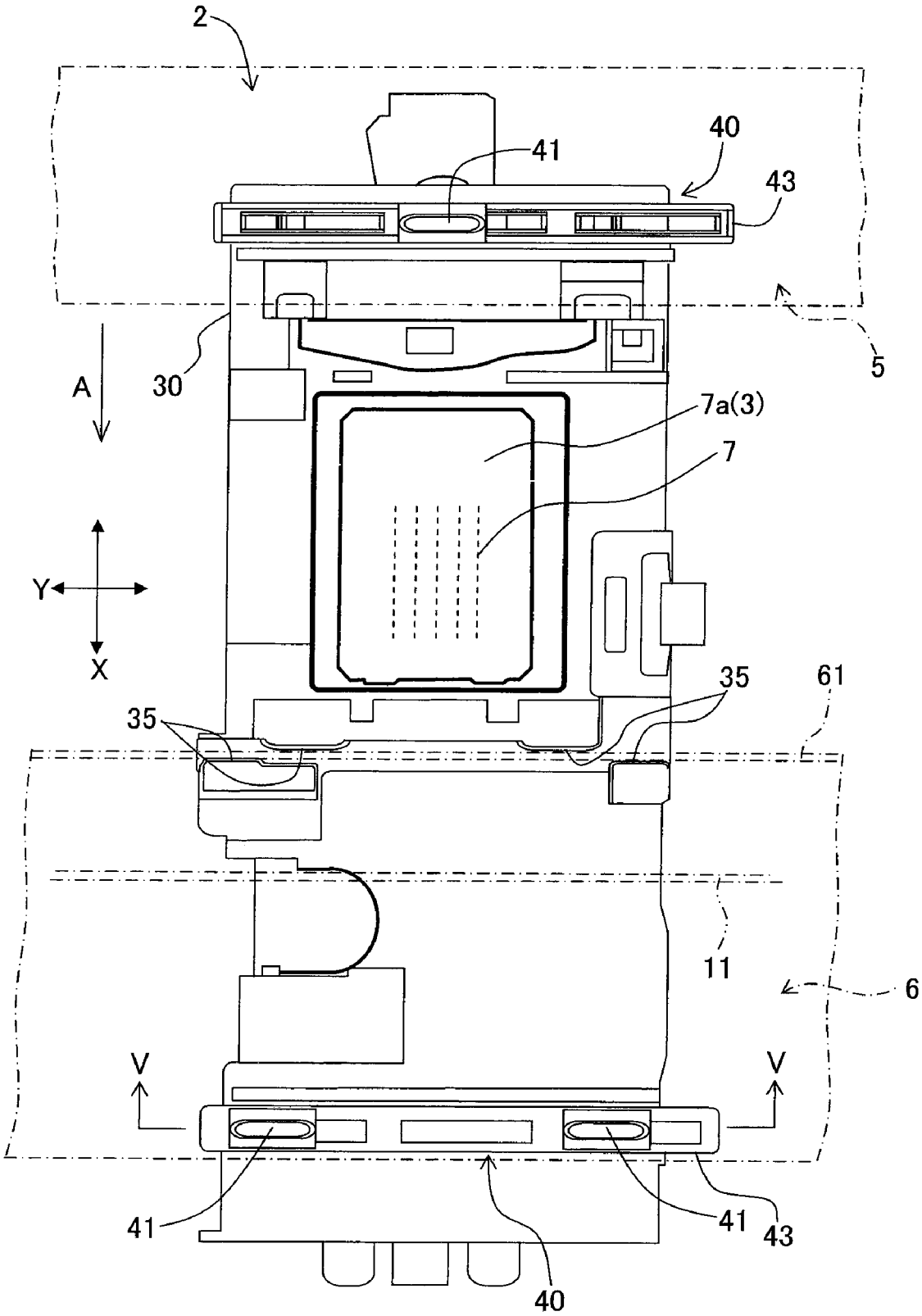
FIG. 4 is a bottom view of a carriage and a head holder 30.

The carriage 2, as shown in FIG. 4, includes the head holder 30 made of a synthetic resin material having a substantially rectangular shape in a plan view, and the jetting head unit 3 with the nozzles 7 pointing downward is installed on a lower surface side of a position toward the upstream side in the paper transporting direction of the head holder 30. A connection supporting portion 32 is formed at a downstream-side site in the paper transporting direction of the head holder 30. A front-end portion of the plurality of ink supply tubes 15 is connected horizontally to the connection supporting portion 32, and ink channels (not shown in the diagram) for supplying the ink to the jetting head unit 3 are formed inside the connection supporting portion 32.

The gap adjusting mechanism 40 for changing a vertical position of the carriage 2 with respect to the first guide member 5 and the second guide member 6 is provided on a lower surface of the head holder 30. The gap adjusting mechanism 40 includes a sliding member 41 which makes a sliding contact with the first guide member 5 and the second guide member 6, and which supports the head holder 30 at a predetermined height, a coil spring 42 as a bias applying member which applies an elastic bias on the sliding member 41 in an upward direction, and the gap adjusting member 43 having a longer shape in a horizontal direction, which is interposed between the head holder 30 and the sliding member 41.

The sliding members 41 are arranged at three locations in all to form a substantially triangular shape (here, an isosceles triangle) in a bottom view of the head holder 30 (refer to FIG. 4). One sliding member 41 is arranged at a upstream-side site in the paper transporting direction, of the jetting head 3 in the head holder 30, and one gap adjusting member 43 is combined with this sliding member 41. A lower surface of the one sliding member 41 slides along a horizontal sliding surface 52 of the first guide member 5. The two sliding members 41 are arranged to be separated on the same line extended along the Y-axis direction at the downstream-side site in the paper transporting direction of the head holder 30, and one gap adjusting member 43 is combined with these two sliding members 41. Since all the sliding members 41 have a similar structure, the structure will be described below by citing the sliding member 41 provided at the downstream-side site in the paper transporting direction as an example.

Figure 5:
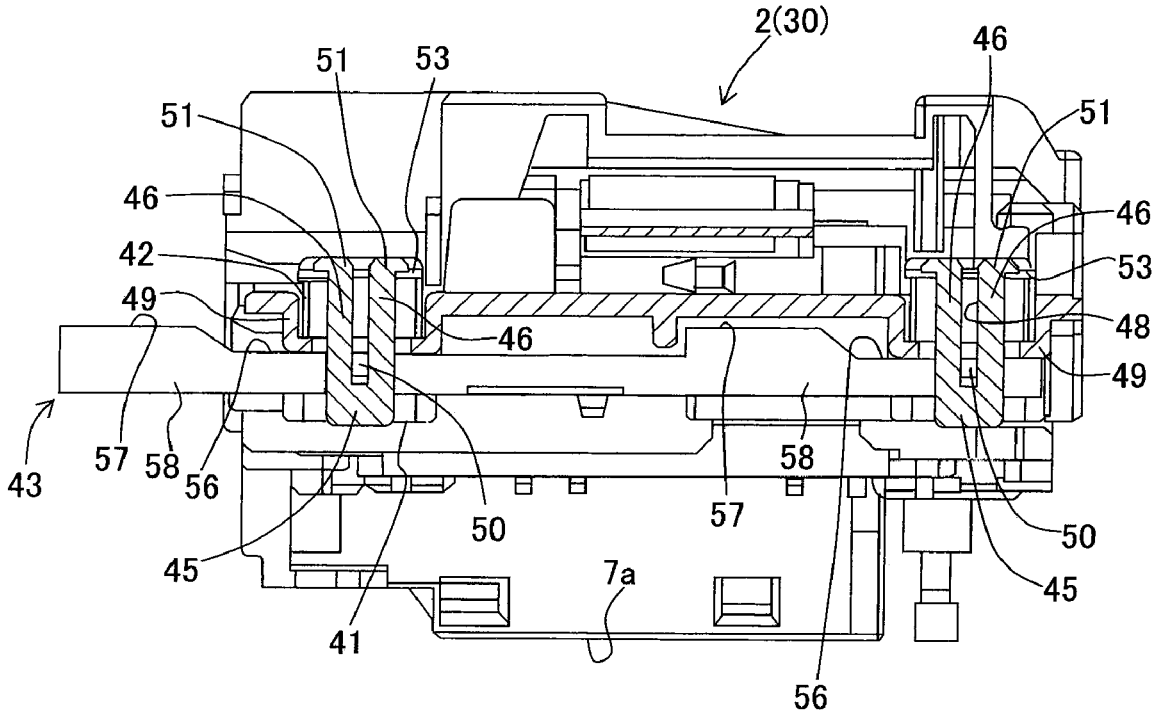
FIG. 5 is a cross-sectional view taken along a line V-V in FIG. 4, showing a gap adjusting mechanism.
Figure 6:
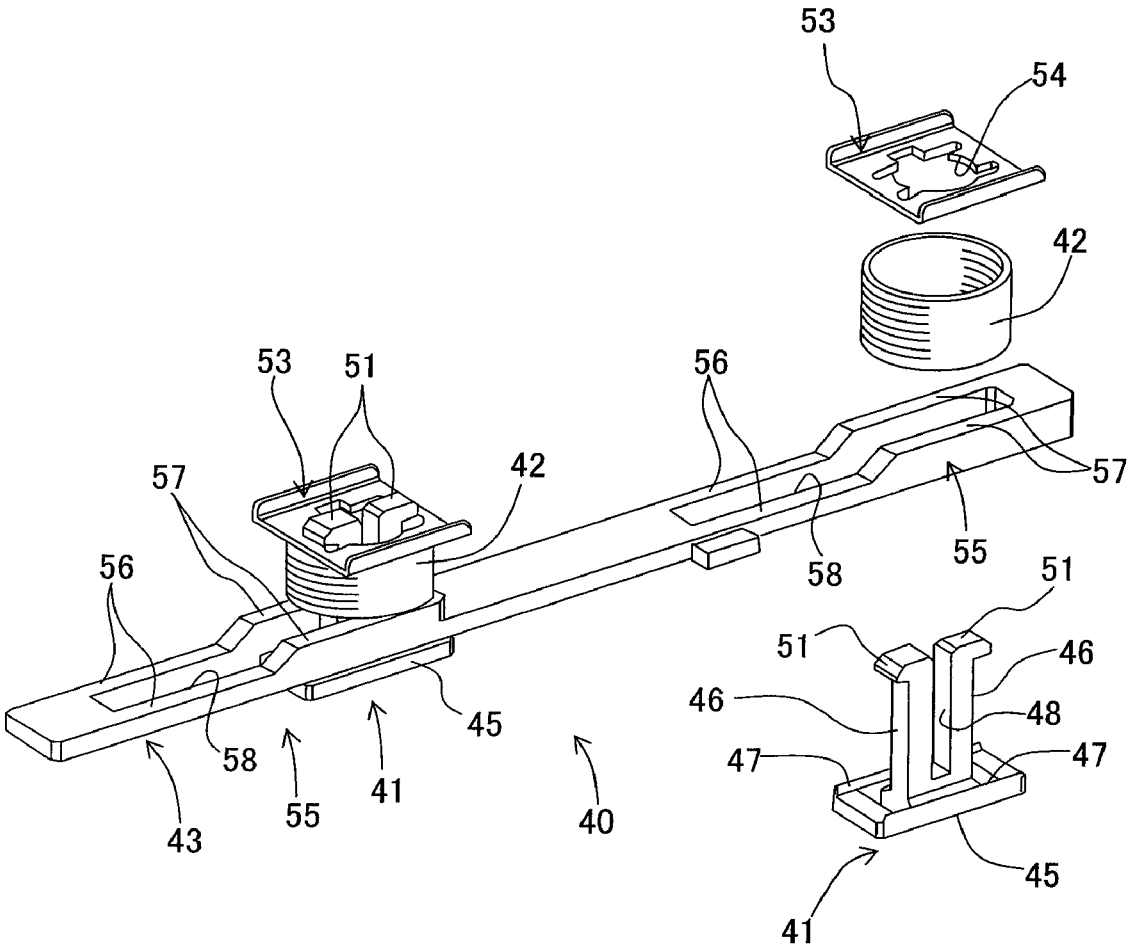
FIG. 6 is an exploded perspective view of members of the gap adjusting mechanism.

As shown in FIG. 5 and FIG. 6, the sliding member 41 has a sliding-contact plate 45 which slides on a sliding surface 62 which is horizontal, of the second guide member 6, and a leg portion 46 in a forked form, which is extended from the sliding-contact plate 45. The sliding-contact plate 45 is a rectangular shaped plate having a substantially same length in a direction of width as a length in a direction of width of the gap adjusting mechanism 43.

A pair of projections 47 are formed on an upper surface of the sliding-contact plate 45, along an edge portion in a longitudinal direction, and by the pair of projections 47 making a uniform contact with a bottom surface of the gap adjusting mechanism 43, a bottom surface of the sliding-contact plate 45 is positioned parallel to the sliding surface 62 (52).

The forked leg portion 46 is extended parallel to a direction substantially orthogonal to the upper surface from a substantial center of the upper surface of the sliding-contact plate 45, and to a longitudinal direction of the gap adjusting member 43. A guide groove 48 which opens upward, between the forked leg portions 46 sandwiches a supporting rib 50 in a through hole positioned at a bottom of a coil mounting portion 49 of the head holder 30 (refer to FIG. 5), and the sliding member 41 is vertically-movably supported along the guide groove 48.

A latching portion 51 which protrudes toward an outside in a longitudinal direction of the sliding-contact plate 45 is formed at both sides of an extended end of the leg portion 46. The latching portion 51, as shown in FIG. 5 and FIG. 6, is for latching the sliding-contact plate 45 with a retaining plate 53. A through hole 54 for inserting the leg portion 46 is drilled through the retaining plate 53. A width of the through hole 54 is narrower than a space between an outer edges of the pair of latching portions 51. The pair of latching portions 51 is a sort of a snap fit. The pair of latching portions 51 is pressed at an inner side to narrow a groove width of the guide groove 48 to be elastically deformed and is inserted into the through hole 54 in the retaining plate 53. When the thrust is released, the pair of latching portions 51 protrudes to an outside of a circumference of the through hole 54 by an elastic return. The sliding-contact plate 45 is latched with the retaining plate 53 by the pair of latching portions 51, such that the leg portion 46 does not slip out from the through hole 54.

As shown in FIG. 5, a coil mounting portion 49 which vertically-movably supports the sliding member 41 is formed to be separated in a sliding direction (left-right direction in FIG. 5) of the carriage 2, and the coil spring 42 is provided at an interior of each coil mounting portion 49. An upper end of the coil spring 42 pushes the retaining plate 53 upward, at an outer side of the leg portion 46.

As shown in FIG. 5 and FIG. 6, the gap adjusting member 43 is a flat plate having a long and slender rod shape, and is interposed between the sliding member 41 and the supporting rib 50.

A pair of adjustment sites 55 of gap separated in a longitudinal direction is provided on the gap adjusting member 43. Each adjustment site 55 is formed such that, a thickness thereof (a vertical direction in FIG. 5 and FIG. 6) changes in two stages in the sliding direction of the gap adjusting member 43. More elaborately, a thin portion 56 having the minimum thickness and a thick portion 57 having the maximum thickness are formed side by side such that the thickness changes in stages in one direction. An upper surface of both the thin portion 56 and the thick portion 57 is a horizontal surface, and a length in the longitudinal direction of each upper surface is slightly longer than a length in the longitudinal direction of the leg portion 46 of the sliding member 41. Moreover, an inclined surface for making the change in the thickness to be gradual is formed at a boundary of the upper surfaces of the thin portion 56 and the thick portion 57.

A long guide hole 58 cut through a direction of thickness of the thin portion 56 and the thick portion 57 is formed in each adjustment site 55, at a substantial center of a direction of width of the gap adjusting member 43. The leg portion 46 is inserted into the long guide hole 58. An extended end of the leg portion 46 inserted through the long guide hole 58 passes through a through hole in the coil mounting portion 49 of the head holder 30.

The coil spring 42 is interposed between the retaining plate 53 and the coil mounting portion 49, and an elastic bias in an upward direction is applied to the retaining plate 53 by the coil spring 42. This elastic bias acts on the sliding member 41 via the retaining plate 53, and the sliding member 41 is subjected to the elastic bias, to be at the uppermost side in a range of a vertical movement allowable by the supporting rib 50. Moreover, since the gap adjusting member 43 is interposed between the sliding-contact plate 45 and the sliding member 41 of the supporting rib 50, the sliding member 41 moves downward, resisting the elastic bias, only by an amount equivalent to the thickness of the adjustment site 55 of the gap adjusting member 43. Since the long guide hole 58 is formed in the adjustment site 55 as described above, the gap adjusting member 43 is slidable in a state of the leg portion 46 of the sliding member 41 passed through the thickness direction. Since the thickness of the adjustment site 55 positioned between the supporting rib 50 and the sliding-contact plate 89 is changed by the sliding movement of the gap adjusting member 43, a position in the vertical direction of the sliding member 41 changes.

An end portion in the sliding direction of the gap adjusting member 43 protrudes from a side surface of the head holder 30, and as shown in FIG. 5, when a left end of the gap adjusting member 43 protrudes long, the thin portion 56 makes a contact with a lower surface of the coil mounting potion 49, and the carriage 2 (the head holder 30) descends with respect to the upper surface of the first guide member 5 and the second guide member 6. Consequently, a gap from the nozzle opening surface 7*a* up to the paper P becomes small. Conversely, when a right end of the gap adjusting member 43 protrudes long, since the thick portion 57 makes a contact with the lower surface of the coil mounting portion 49, the carriage 2 (the head holder 30) ascends relatively, and the gap from the nozzle opening surface 7*a* up to the paper P becomes large. A shape and a disposing position of the contact sites 70*a* (71*a*) and 70*b* (71*b*) and a member for bringing in contact both ends in the sliding direction of the gap adjusting member 43 are not restricted in particular, and may be formed by cutting and bending a predetermined position of the first guide member 5 and the second guide member 6, and it is also possible to let an apparatus frame to be a contact site. Moreover, it is also possible to adopt appropriately a structure in which another contact member is arranged at a predetermined position.

Next, a gap and a capping operation at the time of image recording will be described below while referring to diagrams from FIG. 7A to FIG. 7D.

Figure 7A:
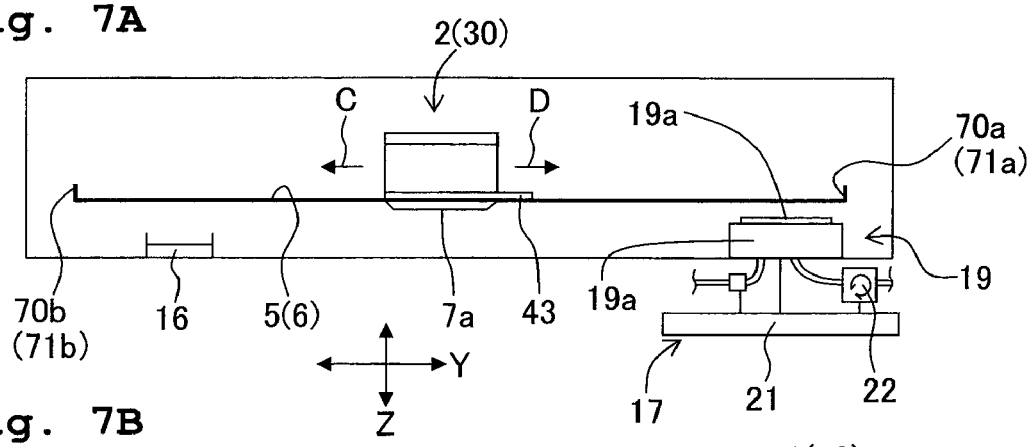
FIG. 7A, FIG. 7B, FIG. 7C, and FIG. 7D (hereinafter, "FIG. 7A to FIG. 7D") are diagrams explaining a gap adjustment and a capping operation.
Figure 7B:
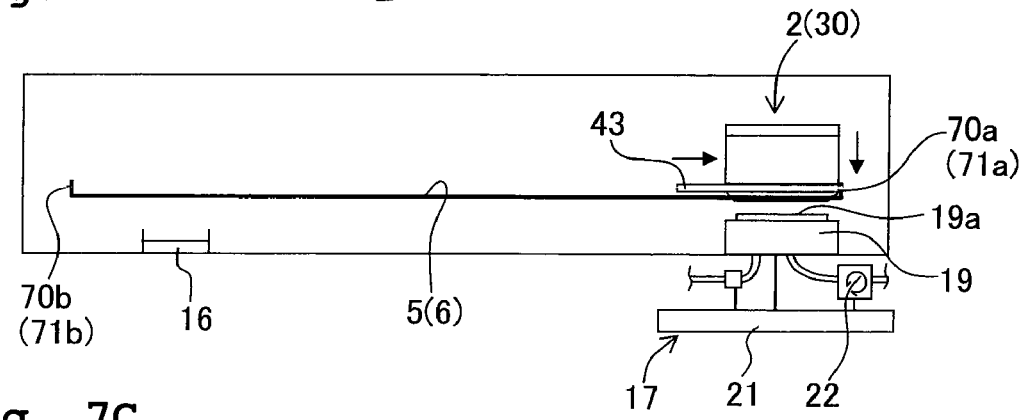

In a case of recording an image on a thick paper such as an envelope and a postcard, as shown in FIG. 7A, the right end of the gap adjusting member 43 is let to be protruded long, and the gap is set to be large (a second position). In this state, in an image recording area (an area between the waste ink receiving section 16 and the maintenance unit 17, corresponds to jetting area in claims), ink is jetted from the nozzles 7 while moving the carriage 2 in a left-right (direction of arrows C and D) direction, and an image is recorded. When the paper P is a regular paper, the carriage 2 (the head holder 30) is moved up to a right end of the first guide member 5 and the second guide member 6. By the right end of the gap adjusting member 43 being pushed by the contact site 70*a* (71*a*) at the right end of the first guide member 5 and the second guide member 6, the gap adjusting member 43 moves in a leftward direction, and as it has been described above, by the thin portion 56 making a contact with the lower surface of the coil mounting portion 49, it is possible to make the gap small (a first position). In this state, an image recording operation may be carried out in the image recording area. A gap between the first position and the second position is about 1 mm.

Figure 7C:
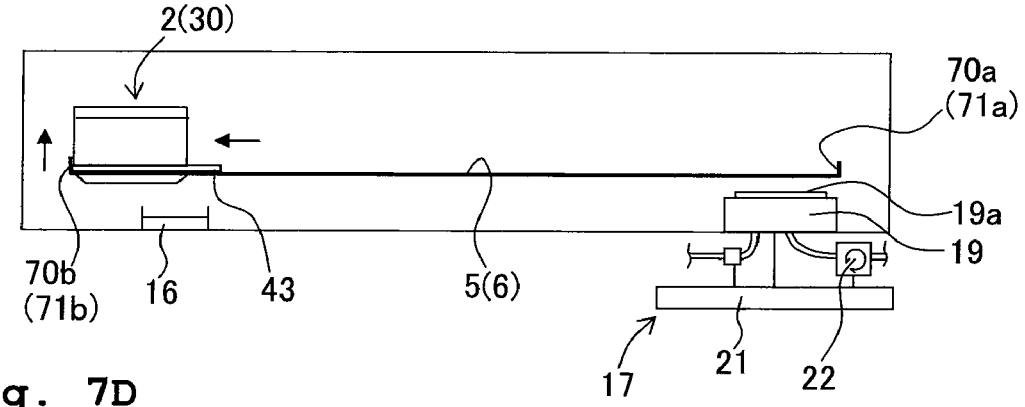
Figure 7D:
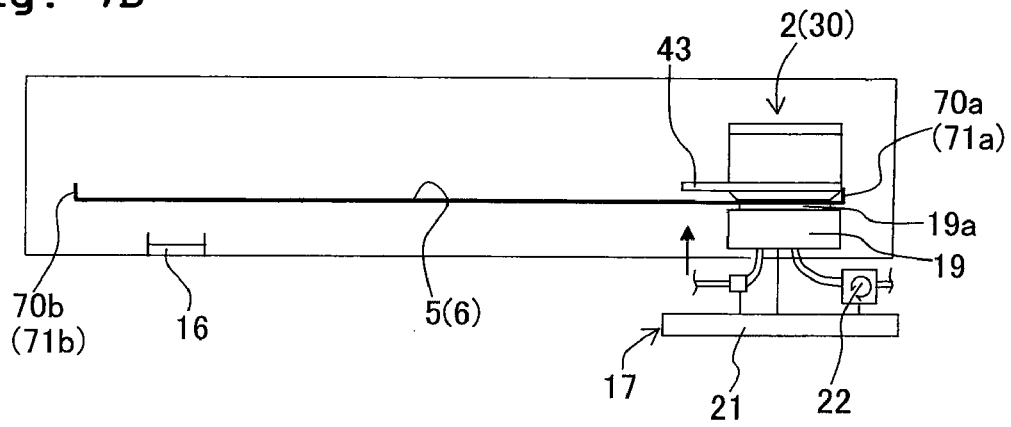

Next, for making the gap large, as shown in FIG. 7C, the carriage 2 (the head holder 30) is once moved up to the left end of the first guide member 5 and the second guide member 6, and while pushing (pressing) the left end of the gap adjusting member 43 against the contact site 70*b* (71*b*) at the left end of the first guide member 5 and the second guide member 6, the gap adjusting member 43 is moved in a rightward direction. Accordingly, the thick portion 57 makes a contact with the lower surface of the coil mounting portion 49, and it is possible to make the gap large.

When the maintenance unit 17 is positioned near the right end of the first guide member 5 and the second guide member 6, by moving the carriage 2 up to a position at which the cap 19 of the maintenance unit 17 covers the nozzle opening surface 7*a* (a maintenance area), the right end of the gap adjusting member 43 is pushed by the contact site 70*a* (71*a*) at the right end of the first guide member 5 and the second guide member 6, and the gap adjusting member 43 moves in a leftward direction. Therefore, by making the cap 19 ascend, in a state of the gap becoming small, it is possible to carry out the capping operation (refer to FIG. 7D).

The maintenance unit 17 may not be arranged near the right end of the first guide member 5 and the second guide member 6, and for instance, may be arranged at a left side (a side near the image recording area) from the contact site 70*a* (71*a*) of the right end of the first guide member 5 and the second guide member 6 as shown in diagrams from FIG. 8A to FIG. 8D.

Figure 8A:
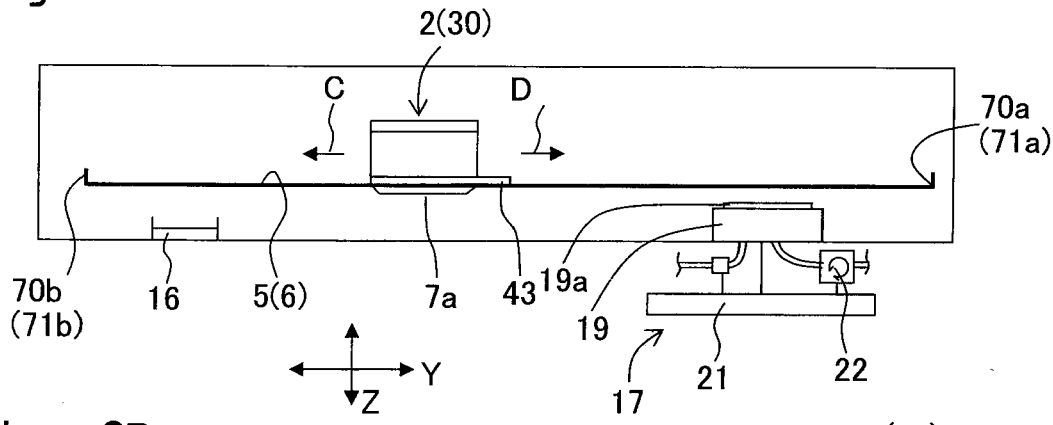
FIG. 8A, FIG. 8B, FIG. 8C, and FIG. 8D (hereinafter, "FIG. 8A to FIG. 8D") are diagrams explaining another example of the gap adjustment and the capping operation.

Even in this case, at the time of recording an image on a thick paper (a board paper), as shown in FIG. 8A, the gap is made large by making the gap adjusting member 43 protrude long. In this state, an image may be recorded by jetting an ink while moving the carriage 2 (the head holder 30) left-right in the image recording area.

Figure 8B:
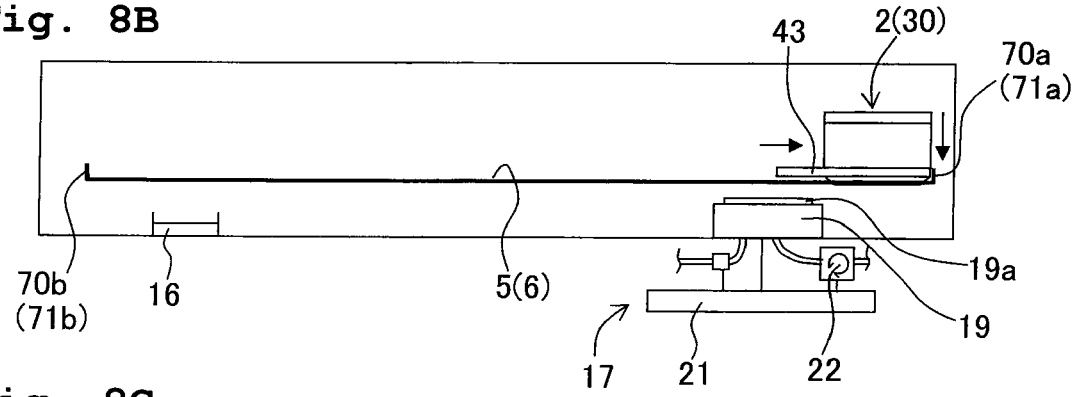

In a case of recording an image on a regular paper, as shown in FIG. 8B, the gap is made small by making the left end of the gap adjusting member 43 protrude substantially toward an outer side in a leftward direction of the head holder 30 by moving the carriage 2 (the head holder 30) at the right end of the first guide member 5 and the second guide member 6. In this state, an image may be recorded by jetting an ink while moving the carriage 2 (the head holder 30) left-right in the image recording area.

Thereafter, in order to make the gap large for recording an image on a thick paper, the carriage 2 (the head holder 30) is once moved up to the left end of the first guide member 5 and the second guide member 6, and the left end of the gap adjusting member 43 is pushed against the contact site 70*b* (71*b*) of the left end of the first guide member 5 and the second guide member 6, and the gap adjusting member 43 is moved in a rightward direction. Accordingly, the thick portion 57 makes a contact with the lower surface of the coil mounting portion 49, and the gap becomes large.

For making the cap 19 ascend at a position of the maintenance unit 17 (maintenance area), and closing the nozzle opening surface 7*a* by the cap 19, the carriage 2 (the head holder 30) is moved in advance up to the right end of the first guide member 5 and the second guide member 6 as shown in FIG. 8B. Moreover, the right end of the gap adjusting member 43 is pushed against the contact site 70*a* (71*a*) at the right end of the first guide member 5 and the second guide member 6, and the gap is made small. In this state, the capping operation may be carried out by making the cap 19 ascent upon returning the carriage 2 (the head holder 30) up to a position facing the maintenance unit 17.

Moreover, the gap adjusting member 43 may be formed to have left and right sides interchanged as opposite in diagrams from FIG. 7A to FIG. 7D. In this case, when a right-end portion of the gap adjusting member 43 protrudes substantially, the gap becomes small, and conversely, when a left-end portion of the gap adjusting member 43 protrudes substantially, the gap becomes large.

Figure 9A:
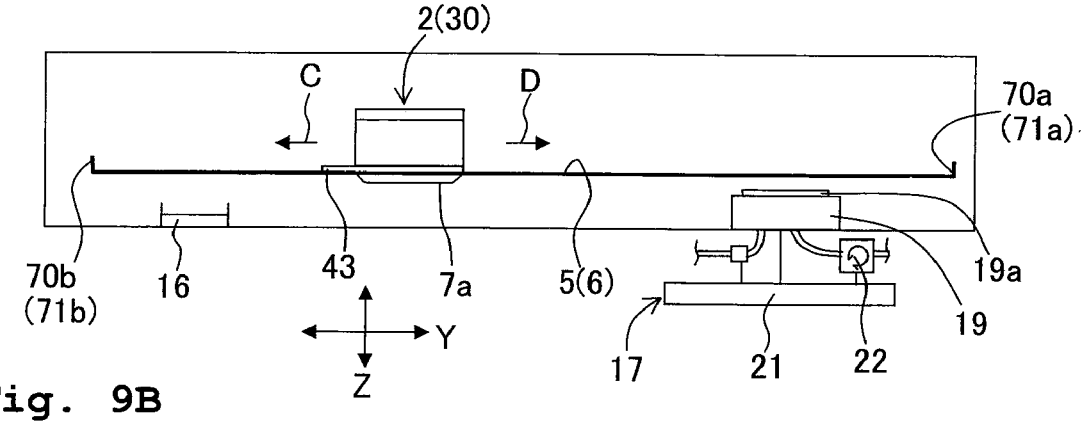
FIG. 9A, FIG. 9B, FIG. 9C, and FIG. 9D (hereinafter, "FIG. 9A to FIG. 9D") are diagrams explaining still another example of the gap adjustment and the capping operation.

In this case, at the time of recording an image on a thick paper, the gap is made large by making the left end of the gap adjusting member 43 protrude long as shown in FIG. 9A.

Figure 9B:
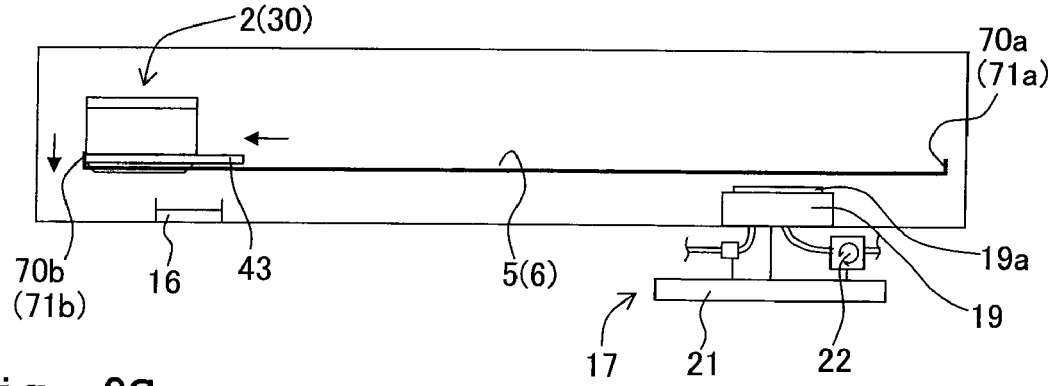
Figure 9C:
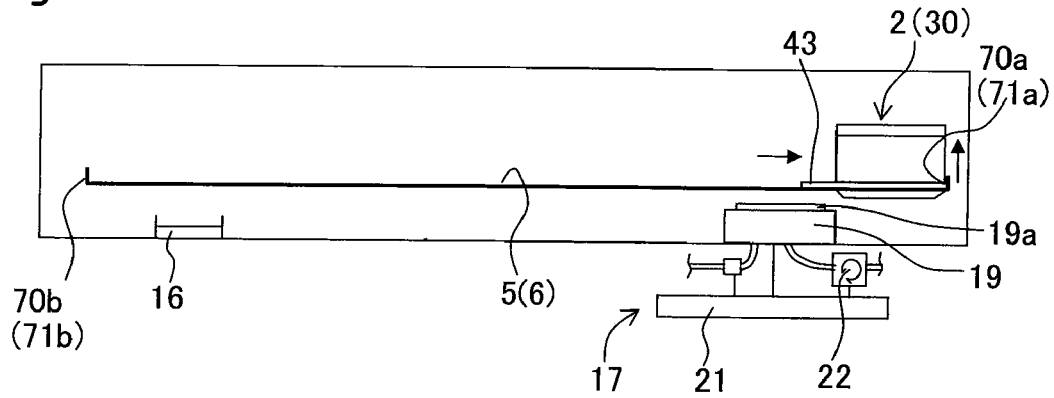
Figure 9D:
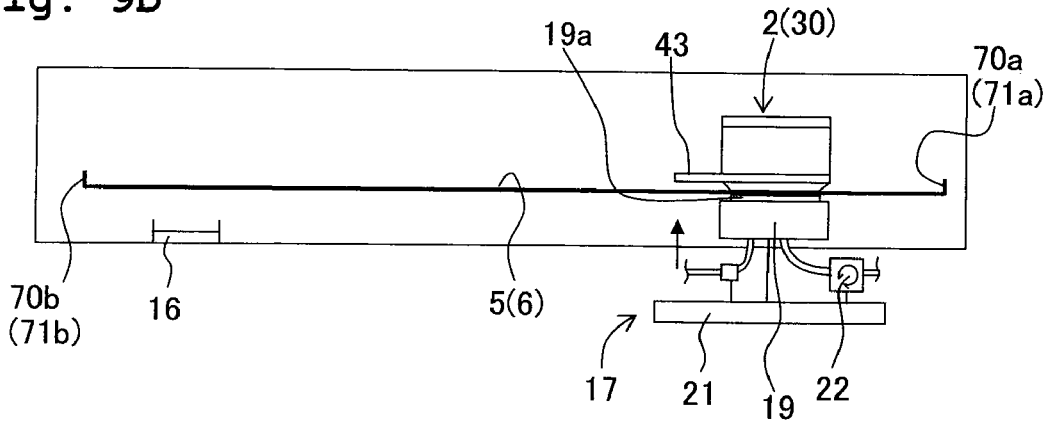

In a case of recording an image on a regular paper, the gap is made small by making the right end of the gap adjusting member 43 protrude substantially at an outer side in a rightward direction of the head holder by moving the carriage 2 (the head holder 30) up to the left end of the first guide member 5 and the second guide member 6 as shown in FIG. 9B. In this state, an image may be recorded by jetting an ink while moving the carriage 2 (the head holder 30) left-right (direction shown by arrows C and D) in the image recording area.

For making the gap large, the carriage 2 (the head holder 30) is once moved up to the right end of the first guide member 5 and the second guide member 6, and by pushing the right end of the gap adjusting member 43 against the contact site 70*a* (71*a*) at the right end of the first guide member 5 and the second guide member 6, the gap adjusting member 43 is moved in a leftward direction. Accordingly, by the thick portion 57 making a contact with the lower surface of the coil mounting portion 49, the gap becomes large.

At the time of carrying out the capping operation, the cap 19 may be made to ascend after the nozzle opening surface 7*a* of the head holder 30 is made to face an ascended position of the cap 19, by moving the carriage 2 (the head holder 30) in a rightward direction up to the position of the maintenance unit 17 (maintenance area) from a state in FIG. 9B.

Figure 12:
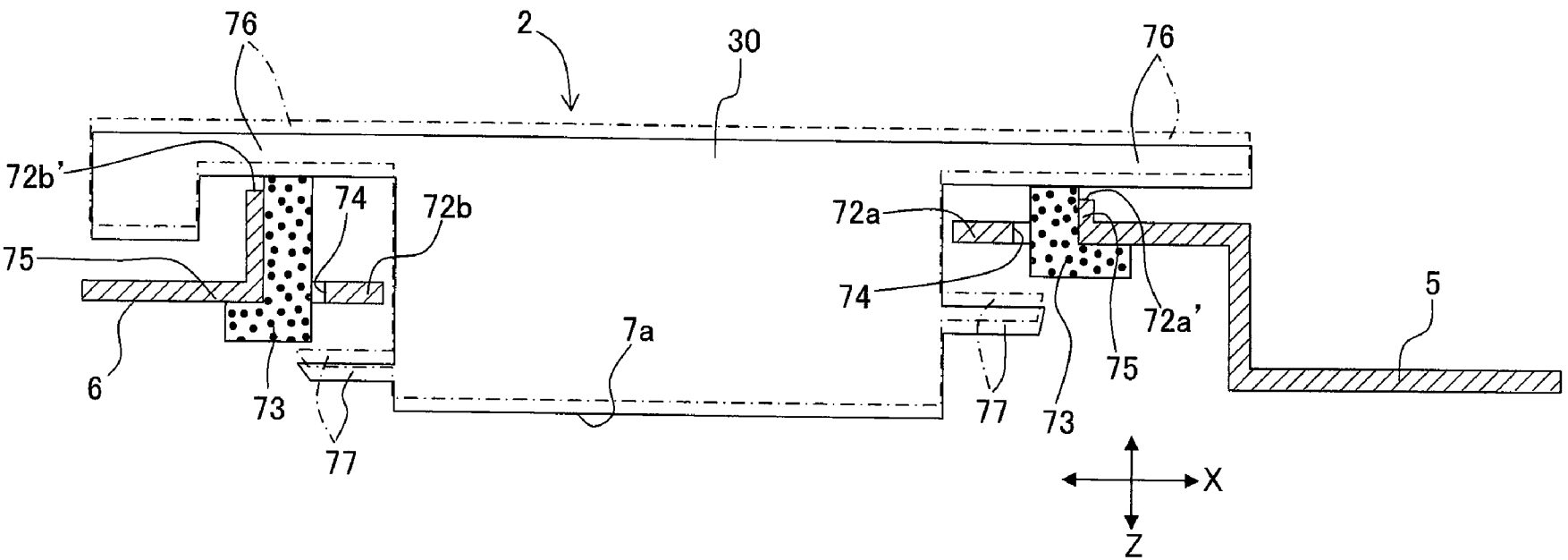
FIG. 12 is a cross-sectional view showing a second embodiment of the meniscus-destruction preventing mechanism.
Figure 13:
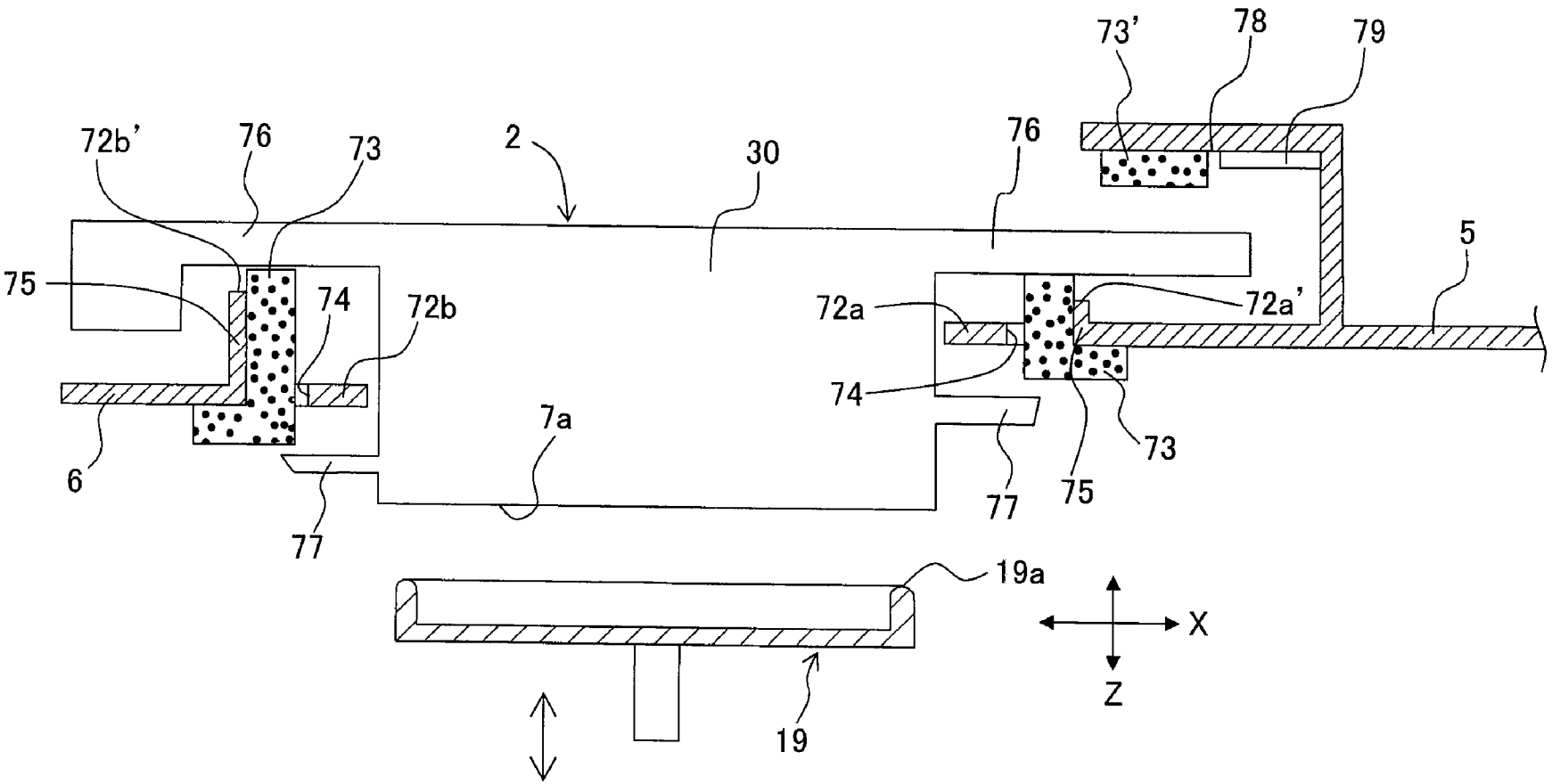
FIG. 13 is a cross-sectional view showing a third embodiment of the meniscus-destruction preventing mechanism.
Figure 14:
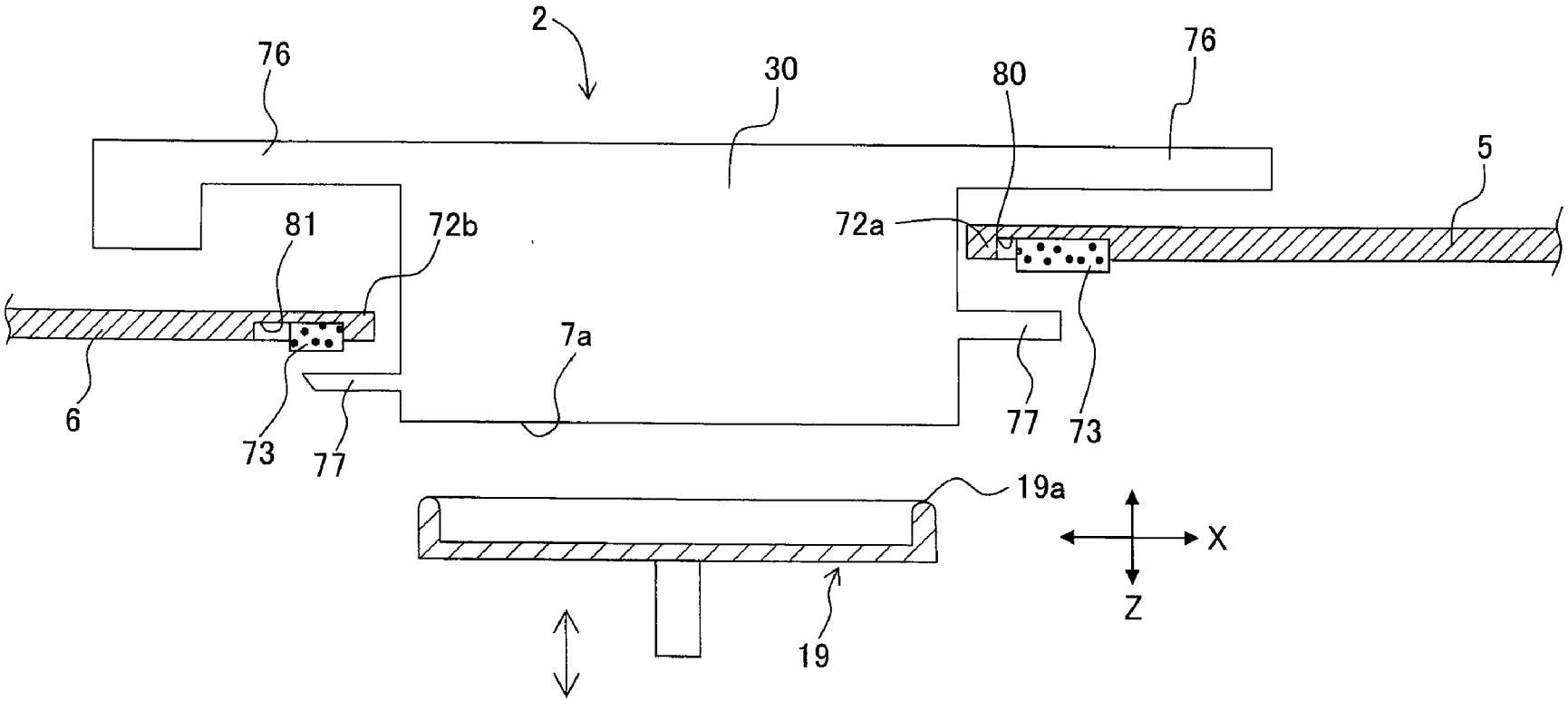
FIG. 14 is a cross-sectional view showing a fourth embodiment of the meniscus-destruction preventing mechanism.

Next, a meniscus-destruction preventing mechanism of the present invention will be described below by using FIG. 10, FIG. 11, FIG. 12, FIG. 13, and to FIG. 14 (FIG. 10 to FIG. 14). In diagrams from FIG. 10 to FIG. 14 to be used for the following description, a model diagram in which a structure of components is simplified based on a side view in FIG. 3 is used. Same reference numerals are assigned to components which are similar, and description of such components is omitted appropriately. Moreover, in diagrams from FIG. 10 to FIG. 14, the gap adjusting member 40, the sliding member 41, and the gap adjusting member 43 are omitted (not shown) for convenience on a paper surface.

Figure 10:
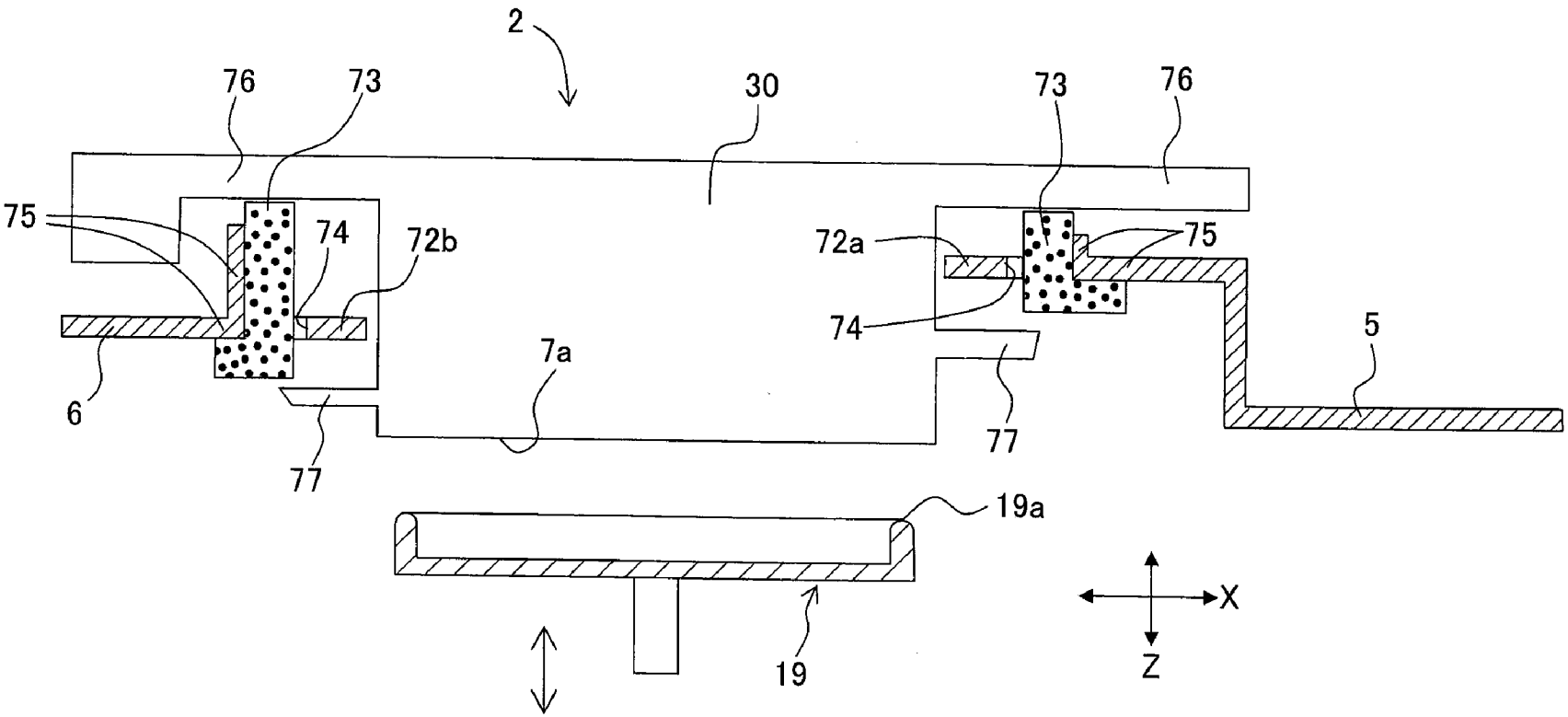
FIG. 10 is a cross-sectional view showing a first embodiment of a meniscus-destruction (meniscus-break) preventing mechanism.

As it has been described above, by a changing operation of the gap, when not only the carriage 2 (the head holder 30) but also the jetting head unit 3 is moved in a direction orthogonal to the nozzle opening surface 7*a* (jetting direction of liquid droplets), an inertial force in a direction opposite to the jetting direction is exerted on the meniscus of the nozzle. Moreover, since the jetting head unit 3 moves in the direction opposite to the jetting direction, following the ascent of the cap 19 by the capping operation, a sealing power of the cap 19 is considered to become small. Therefore, regulating portions 72*a* and 72*b* (stoppers) which regulate the movement of the jetting head unit 3 in the abovementioned opposite direction (direction opposite to the jetting direction) as shown in FIG. 10 are arranged with an object of securing the sealing power. The regulating portions 72*a* and 72*b* are positioned at an opposite side with respect to a lower pushing portion 77 and an upper pushing portion 76 extending from the head holder 30 on which the jetting head unit 3 is mounted. When the inertial force is exerted in the jetting direction due to a displacement in the opposite direction as described above, and when there is an impact by colliding with a fixed portion, since the meniscus of the nozzle is destroyed, in the present invention, a shock absorbing mechanism (buffer mechanism) which reduces the impact by the movement and collision of the head holder 30 (the carriage 2) including the jetting head unit 3 is provided. The displacement in the opposite direction opposite to the jetting direction due to the capping operation of the jetting head unit 3 is about 1 mm to 4 mm.

The shock absorbing mechanism includes a buffer (a first buffer) which is arranged between the head holder 30 and the regulating portion. When the head holder 30 has moved in the opposite direction opposite to the jetting direction of the liquid droplets (ink) out of the axial directions, the head holder 30 reaches a position of making a contact with the regulating portions 72*a* and 72*b* while pushing the buffer.

In a first embodiment thereof, the regulating portions 72*a* and 72*b* are formed integrally on a horizontal portion of the first guide member 5 and the second guide member 6 as shown in FIG. 10. The first buffer 73 is arranged on the first guide member 5 and the second guide member 6, by being inserted into a through hole 74 penetrating in the jetting direction (Z-axis direction in the diagram), and a portion in a vertical direction of the first buffer is fixed by an adhesive etc. to a fixed portion 75 (erected portion) provided to the regulating portions 72*a* and 72*b*. The fixed portion 75 is a contact surface of the buffer 73 and a cut and bent body of a through hole in the first guide member 5 and the second guide member 6 around the through hole 74 and an inner surface of the through hole 74. It is possible to use an elastic body material such as soft rubber, sponge, a low-repulsion urethane resin, or a spring as the buffer 73, and it may be a material by which the buffer 73 may be compressed substantially by an external force. When the buffer 73 is formed of a material in the sponge form which is capable of absorbing a liquid, even when a liquid is leaked from the jetting head unit 3 due to tilting or turning up-side-down the image recording apparatus 1 during transporting for instance, it is possible to absorb the leaked liquid by the buffer. In the first embodiment, each buffer 73 may be formed to have an L-shape in a cross-section. The through hole 74 is formed to be of a size that does not inhibit a compression-deformation even when the buffer 73 is deformed by being compressed substantially.

The upper pushing portion 76 and the lower pushing portion 77 are formed integrally on the head holder 30, to sandwich an upper surface and a lower surface of the buffer 73 at the regulating portions 72*a* and 72*b*. In the embodiment, the regulating portions 72*a* and 72*b*, and the buffer 73 are provided at positions such that, when the head holder 30 is positioned above the maintenance unit 17, the upper pushing portion 76 and/or the lower pushing portion 77 sandwich the buffer.

Figure 11:
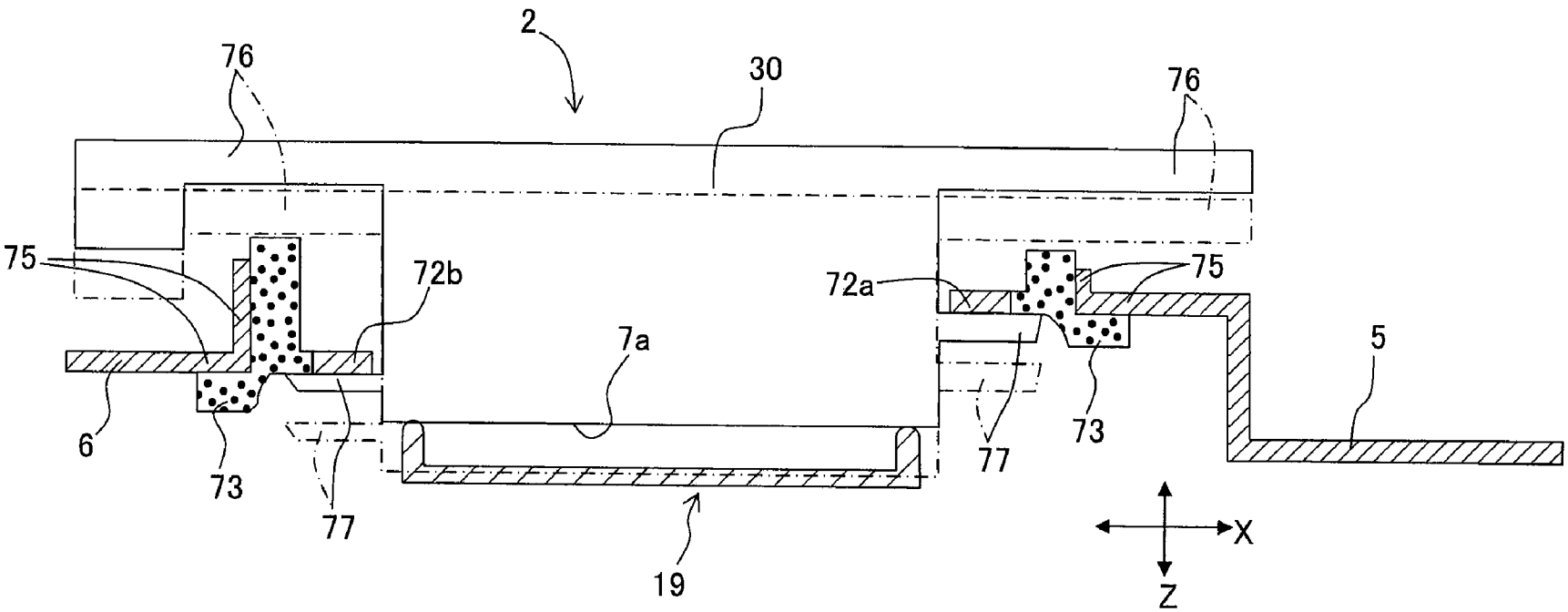
FIG. 11 is a cross-sectional view showing an action of the first embodiment of the meniscus-destruction preventing mechanism.

In the structure described above, as a state shown by solid line in FIG. 10, and long and short dashed lines in FIG. 11, in a state of the head holder 30 descended such that the gap becomes small, when the cap 19 is made to ascend for the capping operation, and the nozzle opening surface 7*a* is pushed up by the rib 19*a*, the meniscus in the nozzle is destroyed due to the impact. The buffer 73 in the first embodiment has a size such that the lower pushing portion 77 makes a contact when the head holder 30 is pushed up by the cap 19. Consequently, during the time till the head holder 30 is pushed up to a position where the lower pushing portion 77 makes a contact with the regulating members 72*a* and 72*b*, by the lower pushing portion 77 making a contact with the lower surface of the buffer 73, and further, the head holder 30 being pushed up, the lower pushing portion 77 compresses a lower portion of the buffer 73, and causes it to deform. Therefore, it is possible to reduce a speed of ascent of the head holder 30 by a resistance. Moreover, in a state of the lower pushing portion 77 making contact with the regulating portions 72*a* and 72*b*, an impact force in an upward direction exerted to the head holder 30 by the regulating members 72*a* and 72*b* becomes substantially low. Moreover, due to the reduction in the velocity of ascent of the head holder 30, since an acceleration acting on the head holder 30 also becomes small, inertial force acting in a direction opposite to the direction of acceleration due to the acceleration becomes small. Therefore, when reached the regulating portions 72*a* and 72*b*, the inertial force in the jetting direction acting on the meniscus in the nozzle 7 becomes small. Accordingly, it is possible to prevent the destruction of the meniscus in each nozzle 7 of the jetting head unit 3. Moreover, as it has been mentioned above, the buffer 73 is arranged at a position closer to the nozzle opening surface 7*a* of the jetting head unit 3 than the gap adjusting mechanism 40, in the first guide member 5 and the second guide member 6. Therefore, it is possible to absorb an impact on the jetting head unit 3 more effectively as compared to a case of absorbing the impact on the jetting head unit 3 at a position away from the nozzle opening surface 7*a*.

Due to the capping operation, the lower pushing portion 77 makes a contact with the regulating portions 72*a* and 72*b*, and further, a position up to which, the cap 19 is displaced, which is a position at which a sufficient sealing power is achieved by making a close contact with the nozzle opening surface, corresponds to a "capping position" of the present invention.

Figure 8C:
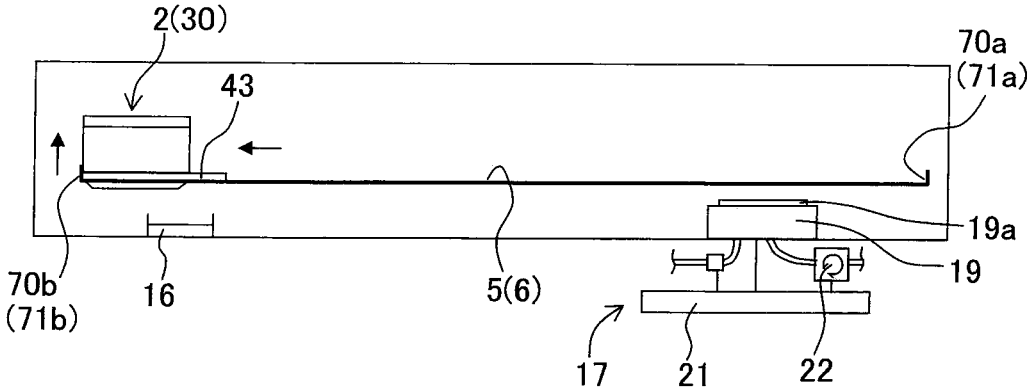
Figure 8D:
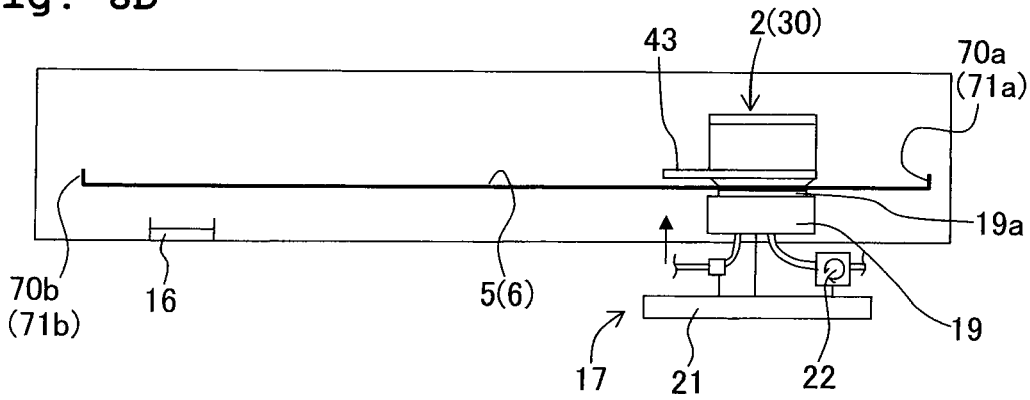

In a second embodiment shown in FIG. 2, it is a shock absorbing mechanism which prevents the meniscus from being destroyed by an impact when the head holder 30 including the jetting head unit 3 descends (displacement from the second position to the first position), and collides with an upper surface of the regulating portions 72*a* and 72*b*. The structure is effective in a case of returning the gap to an original small gap by pushing the left end of the gap adjusting member 43 against the contact site 70*b* (71*b*) at the left end, by moving the carriage 2 (the head holder 30) once up to the left end of the first guide member 5 and the second guide member 6 as shown in FIG. 7C and FIG. 8C for example. Therefore, in the second embodiment, the upper surface of each buffer 73 is projected above an upper surface (erected front end) of regulating portions 72*a*' and 72*b*' which is an upper surface of the fixed portion 75. Consequently, when the head holder 30 descends as in a state shown by long and short dashed lines in FIG. 12, the upper pushing portion 76 on the head holder 30 makes a contact with the upper surface of the buffer 73 first, and with the further descent of the head holder 30, it is possible to deform the upper portion of the buffer 73 by compressing by the upper pushing portion 76. Accordingly, since it is possible to reduce a speed of descent of the head holder 30 as compared to a case of bringing in contact with the buffer 73, and making descend, it is possible to prevent the meniscus from being destroyed, as compared to a case in which the buffer 73 is not provided.

Even in the second embodiment shown in FIG. 12, it is possible to prevent the meniscus in the jetting head unit 3 from being destroyed, by arranging the buffer 73 such that the lower pushing portion 77 deforms by compressing the lower surface of the buffer 73 before the lower pushing portion 77 makes a contact with the lower surface of the regulating portions 72*a* and 72*b* when the head holder 30 has ascended by the capping operation. In other words, since the buffer 73 is provided near the maintenance area of the first guide member 5 and the second guide member 6, it is possible to absorb by the first buffer, not only an impact exerted on the jetting head unit 3 when the jetting head unit 3 is displaced from the second position to the first position by the gap adjusting mechanism, but also an impact exerted on the jetting head unit 3 at the time of the capping operation.

In a third embodiment shown in FIG. 13, in the gap adjustment, the position of the buffer differs in a case of adjustment in which the gap is made large (ascending operation of the head holder 30) and in a case of adjustment in which the gap is made small (descending operation of the head holder 30). In the third embodiment, as shown in a right side of FIG. 13, a separate fixed portion 78 and a regulating portion 79 are provided to the first guide member 5 such that the fixed portion 78 and the regulating portion 79 are positioned at an upper side of the upper pushing portion 76 of the head holder 30. Moreover, another buffer 73' (a second buffer) is fixed on a lower surface of the fixed portion 78.

In the third embodiment, similarly as in the second embodiment shown in FIG. 12, when the head holder 30 descends and the gap is adjusted to be small, the upper pushing portion 76 makes a contact with and presses the upper surface of the buffer 73 to deform the buffer 73, before the upper pushing portion 76 makes a contact with an upper surface of the regulating portions 72*a*' and 72*b*'. Whereas, when the head holder 30 ascends and the gap is adjusted to be large, the upper surface of the upper pushing portion 76 makes contact with and presses the lower surface of the buffer 73' to deform the buffer 73', before the upper surface of the upper pushing portion 76 makes a contact with a lower surface of the regulating portion 79. Accordingly, it is possible to absorb the shock by the buffer 73'. In the compression deformation of the buffer 73' in this case, almost the entire buffer 73' is flat. The third embodiment is applicable to any of the left end and the right end of the first guide member 5 and the second guide member 6 in the embodiment shown in FIG. 7, FIG. 8, and FIG. 9. A part of the buffer 73, which is deformed by compression is engaged (moved) to reduce a space of the through hole 74 (installing hole).

In a fourth embodiment shown in FIG. 14, a recess 80 and a recess 81 are portions which are adjacent to the regulating portions 72*a* and 72*b* provided on the lower surface of the first guide member 5 and the second guide member 6, and which fix the buffer 73. A part (such as only the upper surface) of the buffer 73 is fixed by an adhesive inside such recesses 80 and 81 (accommodating portion). In the fourth embodiment, the lower pushing portion 77 makes a contact with and presses the lower surface of the buffer 73 and the buffer 73 deforms, before the lower pushing portion 77 makes a contact with the lower surface of the regulating portions 72*a* and 72*b*. Accordingly, a thickness of the buffer 73 is reduced, and a length and a width of the buffer 73 are extended in a horizontal direction inside the recesses 80 and 81. Eventually, the upper surface of the lower pushing portion 77 makes a contact with the lower surface of the regulating portions 72*a* and 72*b*, and a height position is regulated (determined). By the buffer 73 being deformed by compression in such manner, it is possible to move the buffer 73 to a space in the recesses 80 and 81. The buffer 73, without being restricted to the fourth embodiment, is compressed inside the through hole 74 at the time of capping, in the embodiments described above.

In the embodiments described above, the gap adjusting mechanism has two stages, namely large and small. However, it is also applicable to a gap adjusting mechanism in which an adjustment site (a portion which make a contact with the lower surface of the coil mounting portion 49) of thickness having three stages is formed on an upper surface of the gap adjusting member 43 in the embodiments described above.

In the embodiments described above, the buffer 73 has been provided to each of the first guide member 5 and the second guide member 6. However, a buffer may be provided on the lower surface of the upper pushing portion 76 of the carriage 2 and the upper surface of the lower pushing portion 77 of the carriage 2. Even in this case, it is possible to absorb an impact exerted on the jetting head unit 3 by the buffer.

In the embodiments described above, both the first guide member 5 and the second guide member 6 are formed in the form of a flat plate. However, the form of the first guide member 5 and the second guide member 6 is not restricted to the flat plate, and both the first guide member 5 and the second guide member 6 may be formed as a cylindrical shaped shaft that fits in the carriage 2, or one of the first guide member 5 and the second guide member 6 may be formed to be in the form of a flat plate and the other may be formed as a cylindrical shaped shaft. In a case of forming the guide member as a cylindrical shaped shaft, the gap between a nozzle surface and a printing surface may be adjusted by biasing the cylindrical shaped shaft by a spring and the like. In this case, it is not necessary to provide the gap adjusting mechanism 40 on the lower surface of the head holder 30.

Moreover, the regulating member in the present invention is not required to be provided integrally to the first guide member 5 and the second guide member 6, and may be formed as a separate member. Furthermore, the first guide member 5 and the second guide member 6 may be not in the form of a plate, but in the form of a rod. In the embodiments described above, the fixed portion 75 is arranged to be erected in the jetting direction and the opposite direction out of the first guide member 5 and the second guide member 6. However, the fixed portion 75 may be erected also toward the jetting direction. When the fixed portion 75 is erected toward the jetting direction, the positional relationship is required to be such that the fixed portion 75 does not make a contact with the lower pushing portion 77. The fixed portion 75 erected in the jetting direction and toward the opposite direction may be positioned to cover a circumference of the through hole 74. Accordingly, since it is possible to make large a contact area of the fixed portion 75, it is possible to strengthen the fixing of the buffer 73. Moreover, a direction in which the through hole 74 is cut is not restricted to the jetting direction, and may be any direction provided that it is a direction having a jetting-direction component.

Furthermore, the present invention is applicable not only to a jetting head unit which moves along the first guide member 5 and the second guide member 6 but also to a line head in which a plurality of nozzles is arranged serially in the scanning direction. The present invention is also applicable to adjusting a gap between a recording paper and a head surface at the time of recording an image by using the line head for example. Moreover, the jetting head unit of the present invention is not restricted to a liquid droplet jetting apparatus which jets liquid droplets in a vertically downward direction, and is also applicable to a liquid droplet jetting apparatus which is capable of jetting in various jetting directions, such as a liquid droplet jetting apparatus which jets liquid droplets in a horizontal direction.

Moreover, in the abovementioned description, an example in which the present invention is applied to a printer which performs printing by jetting the ink droplets to the recording paper is shown. However, the present invention is also applicable to other printing apparatuses which jet a liquid other than the ink, to a recording medium. It is also possible to apply the present invention to a printing apparatus which forms a wiring pattern by jetting onto a substrate, an electroconductive liquid in which metallic nano particles are dispersed, a printing apparatus to product a DNA chip by using a solution in which DNA is dispersed, and a printing apparatus to product a color filter for liquid crystal display by using a liquid in which pigments for the color filter are dispersed.

What is claimed is:

1. A liquid droplet jetting apparatus which jets liquid droplets of a liquid onto a recording medium, comprising:

a jetting head unit having a nozzle opening surface on which nozzles for jetting the liquid droplets are open, and the jetting head unit being configured to be displaced in a jetting direction in which the liquid droplets are jetted from the nozzles toward the recording medium and in an opposite direction opposite to the jetting direction;

a capping mechanism including a cap covering the nozzle opening surface, and which moves the cap in the opposite direction from a stand-by position, which is away from the nozzle opening surface, to a capping position at which the cap is brought into contact with and covers the nozzle opening surface;

a stopper which is arranged with a spacing distance from the jetting head unit, and which regulates a displacement of the jetting head unit in the opposite direction;

a guide member extending in an orthogonal direction orthogonal to the jetting direction, guiding the jetting head unit;

a moving mechanism which moves the jetting head unit along the guide member to a jetting area, at which the jetting head unit jets the liquid droplets onto the recording medium, and to a maintenance area which is outside the jetting area;

a gap adjusting mechanism which adjusts a position of the jetting head unit between a first position at which the nozzle opening surface is away from the recording medium by a predetermined distance in the jetting direction, and a second position at which the nozzle opening surface is away from the recording medium at a distance greater than the predetermined distance; and a first buffer which is arranged between the jetting head unit and the stopper;

wherein the capping mechanism is arranged in the maintenance area, and the guide member has the stopper and the first buffer at a portion corresponding to the maintenance area, wherein the guide member has a through hole which penetrates the guide member in a penetrating direction including a jetting-direction component and into which the first buffer is inserted, and an erected portion which is formed around the through hole and which is erected in the penetrating direction, wherein the first buffer is inserted into the through hole and is fixed to the erected portion and an inner wall of the through hole such that an end portion of the first buffer projects from an end of the erected portion, wherein, when the capping mechanism moves the cap in the opposite direction to make the jetting head unit contact with the stopper, the first buffer contracts by being pressed by the jetting head unit, and wherein, when the jetting head unit is displaced from the second position and positioned at the first position by the gap adjusting mechanism, the first buffer contracts by being pressed by the jetting head unit.

2. The liquid droplet jetting apparatus according to claim 1;

wherein the first buffer is formed of a material in a sponge form which is capable of absorbing the liquid.

3. The liquid droplet jetting apparatus according to claim 1, further comprising:

a second buffer which is different from the first buffer;

wherein, when the capping mechanism moves the cap in the opposite direction to displace the jetting head unit from the first position to the second position, the second buffer contracts by being pressed by the jetting head unit.

4. The liquid droplet jetting apparatus according to claim 1, further comprising:

a carriage which holds the jetting head unit, and which is attached to the guide member to be slidable in the orthogonal direction via a sliding portion;

wherein the first buffer is arranged nearer to the nozzle opening surface of the jetting head unit, than the sliding portion of the carriage.

5. The liquid droplet jetting apparatus according to claim 1; wherein the gap adjusting mechanism adjusts the position of the jetting head unit from the second position to the first position in the maintenance area.

6. The liquid droplet jetting apparatus according to claim 1; wherein the jetting head unit which is being displaced in the opposite direction with the nozzle opening surface covered by the cap is brought into contact with the stopper and the stopper regulates the displacement of the jetting head unit.

* * * * *